US006880716B2

(12) United States Patent
Gottainer et al.

(10) Patent No.: US 6,880,716 B2
(45) Date of Patent: Apr. 19, 2005

(54) PLASTIC LID CONSTRUCTION

(76) Inventors: Joseph Gottainer, 100 E. Bellevue Pl. #17D, Chicago, IL (US) 60611; John W. von Holdt, 3121 Mary Kay La., Glenview, IL (US) 60025

( * ) Notice: Subject to any disclaimer, the term of this patent is extended or adjusted under 35 U.S.C. 154(b) by 0 days.

(21) Appl. No.: 10/434,849

(22) Filed: May 9, 2003

(65) Prior Publication Data

US 2004/0222226 A1 Nov. 11, 2004

(51) Int. Cl.[7] ..... B65D 43/26
(52) U.S. Cl. ..... 220/284; 215/302
(58) Field of Search ..... 220/284, 285, 220/286, 297, 274, 275, 260; 215/302, 303, 304, 215

(56) References Cited

U.S. PATENT DOCUMENTS

| | | | | |
|---|---|---|---|---|
| 3,811,597 A | * | 5/1974 | Frankenberg et al. | 220/284 |
| 4,125,246 A | | 11/1978 | von Holdt | |
| 4,165,018 A | * | 8/1979 | Giggard | 220/284 |
| 4,177,930 A | * | 12/1979 | Crisci | 220/284 |
| 4,210,258 A | | 7/1980 | von Holdt | |
| 4,308,970 A | | 1/1982 | Von Holdt | |
| 4,349,119 A | | 9/1982 | Letica | |
| 4,367,821 A | | 1/1983 | Holt | |
| 4,375,948 A | | 3/1983 | von Holdt | |
| 4,380,305 A | | 4/1983 | Von Holdt | |
| 4,444,332 A | | 4/1984 | Widen et al. | |
| 4,452,382 A | | 6/1984 | Von Holdt | |
| 4,512,493 A | | 4/1985 | Von Holdt | |
| 4,512,494 A | | 4/1985 | Von Holdt | |
| 4,524,882 A | | 6/1985 | Buc | |
| 4,574,974 A | | 3/1986 | von Holdt | |
| 4,735,337 A | | 4/1988 | von Holdt | |
| 4,930,656 A | | 6/1990 | Blanchette | |
| 5,294,015 A | * | 3/1994 | Landis | 220/784 |
| 5,437,386 A | | 8/1995 | von Holdt | |
| 5,460,287 A | | 10/1995 | Cargile et al. | |
| 5,538,154 A | | 7/1996 | von Holdt | |
| 5,725,122 A | * | 3/1998 | Murphy et al. | 220/521 |
| 5,730,309 A | | 3/1998 | Jiradejnunt et al. | |

FOREIGN PATENT DOCUMENTS

| | | |
|---|---|---|
| EP | 0 215 756 | 3/1987 |

* cited by examiner

*Primary Examiner*—Lien M. Ngo
(74) *Attorney, Agent, or Firm*—Banner & Witcoff, Ltd.

(57) ABSTRACT

A molded plastic lid construction employs a peripheral edge section which includes first and second spaced, adjacent, radially discrete hoop sections or depending flanges connected together by a horizontal, annular section. The outermost hoop section or flange includes a projecting horizontal shelf extending partially around the lid. A slot is provided in the shelf for inserting the blade of a tool so that the outer hoop may be elastically deformed to facilitate release of the lid from the rim of a bucket, for example. A lid release flange depends downwardly from the shelf to provide a manual release flange that may also be used to elastically deform and reclose the lid from a bucket.

5 Claims, 4 Drawing Sheets

PLASTIC LID CONSTRUCTION

BACKGROUND OF THE INVENTION

In a principal aspect, the present invention relates to a molded plastic lid compatible with and designed for attachment to the top of a container or bucket.

The use of one gallon plastic buckets for paint and other liquids has not yet been universally adopted. Nonetheless, there are numerous constructions that have been patented and which are directed to the combination of a molded plastic bucket and lid. Further, the use of a molded plastic lid in combination with a formed metal bucket constitutes an alternative method for packaging liquid materials. Additionally, the concepts of molded plastic containers and lids is not limited to one gallon paint type containers which are generally cylindrical in shape. That is, molded plastic buckets having a five gallon capacity and a compatible lid have been known for some time. Smaller packages utilizing molded plastic lids are known. Further, the configuration of the container or bucket need not necessarily by cylindrical or circular in cross section. Thus, rectangular shaped containers and containers having various other shapes may be provided, and lids compatible therewith may also be provided.

A problem often encountered with such containers is the effective removal of a lid as well as the design of a lid which will provide a good seal of the lid to the top rim of the container. Providing a good seal while also providing a means for removal of the lid is a desirable objective for such containers.

As further background, the designs for molded plastic buckets or containers are disclosed in numerous patents including the following: U.S. Pat. Nos. 4,375,948; 4,574,974; 4,512,494; 4,512,493; 4,452,382; 4,380,305; 4,308,970; 4,210,258; 5,538,154; and 5,437,386. These buckets are containers for food, paint, solvents and chemicals are generally made from molded plastic materials.

Typically, the design of the mouth or upper rim or open end of a plastic bucket or other type of container is designed to be compatible with a lid. The use of a molded plastic lid is a desirable objective. U.S. Pat. No. 5,538,154 entitled "Snap On Flexible Lid" discloses a plastic lid with a peripheral flange that is constructed to enhance the "drop strength" of the lid while maintaining flexibility adequate to permit removal of the lid from a container. Drop strength involves the characteristic of the lid to maintain attachment thereof to a container even when dropped from various heights. U.S. Pat. No. 5,477,386 entitled "Container with Tamper Evident Lid Removal Means" discloses further embodiments of compatible molded plastic lids that are designed to be compatible with the top rim or open end of a bucket.

Despite all of the various constructions, there has remained a need for development of a molded plastic lid having excellent "drop strength", good sealing capability, and ease of removal and replacement of the lid on the open end of a bucket or other container. It is with these objectives in mind that the present invention was developed.

SUMMARY OF THE INVENTION

Briefly, the present invention is directed to the construction of a molded plastic lid which may be used in combination with a bucket of the type having an open top with a circumferential top rim. The top rim of the bucket typically includes a peripheral, flat top surface and an outwardly projecting rib extending from the top surface or adjacent the top surface radially outwardly. The inside or opposite side of the top rim of the bucket typically comprises a smooth, planar surface which constitutes an upward extension of the inside cylindrical or other inside planar surface of the container. In other words, the bucket or container includes a top rim with an outwardly protruding lip or rib from the top rim and a generally planar, smooth extension of the interior surface of the container or bucket on the inside thereof.

The subject matter of the invention relates more particularly to the construction of the lid which is compatible with the top rim of the bucket or container. The outer edge section of the lid, in cross section, includes an outer, depending gripping hoop or flange, having an inwardly extending planar surface. The outer hoop or flange thus includes an inwardly projecting lip dimensioned to fit under the lip or rib projecting from the top rim of the bucket. The outer flange further extends downwardly to thereby provide a first flange or annular hoop having an outside face or surface of the lid and providing hoop strength to the lid. A special lid release flange extends further downwardly from the first hoop or peripheral depending outer flange. The lid release flange is positioned radially outwardly from the peripheral annular hoop to define a shelf and surface which is generally horizontal and extends radially outward from the first annular hoop. A slot is located extending through the horizontal shelf adapted and sized to receive insertion of a tool blade. The tool blade may be engaged in the slot so that the upper edge of the first annular hoop or flange will serve as a fulcrum for the tool inserted through the slot to thereby permit elastic distortion of the first hoop or flange and effect release from the rim of the bucket. Thus, by pushing on the tool with a lever arm having a fulcrum on the top, outer edge of the first flange, a mechanical advantage is achieved to effect elastic deformation of the first flange thereby effecting release of the lid from the bucket. The slot which is defined in the horizontal ledge connecting the peripheral downwardly depending first hoop with the lid release flange extension therefrom is generally perpendicular to a radius of a circular lid. This enables maximization of the mechanical advantage for elastically deforming the downwardly extending first flange to effect disengagement thereof from the rim of a bucket or the like. The shelf defined by the connection between the first lid flange and the lid release flange extends laterally from each side of the slot. The lid release flange extends downwardly from the shelf to enable manual gripping thereof so that the lid release flange may be gripped in lieu of utilization of a tool in the slot as previously described. Further, utilization of the tool in the slot in combination with manual gripping of the lid release flange will facilitate removal of the lid from a bucket or other container.

Thus, it is an object of the invention to provide an improved construction for a container lid.

It is a further object of the present invention to provide a construction for a container lid which will effect a positive sealing action in combination with the top rim of a container.

Yet another object of the invention is to provide a molded plastic lid construction which may be disengaged from a bucket or other container by means of a tool which will facilitate the removal of the lid by engagement thereof with the lid by providing a means for achieving a mechanical advantage when doing so.

Yet another object of the invention is to provide a design and construction for an injection molded plastic lid which maintains its structural integrity when placed upon a container in a manner which will maintain a seal between the lid and the container.

A further object of the invention is to provide a molded plastic lid construction which is economical, easy to manufacture, which provides a good seal with respect to a molded container and which also provides a means for facilitating removal of the lid from the container.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
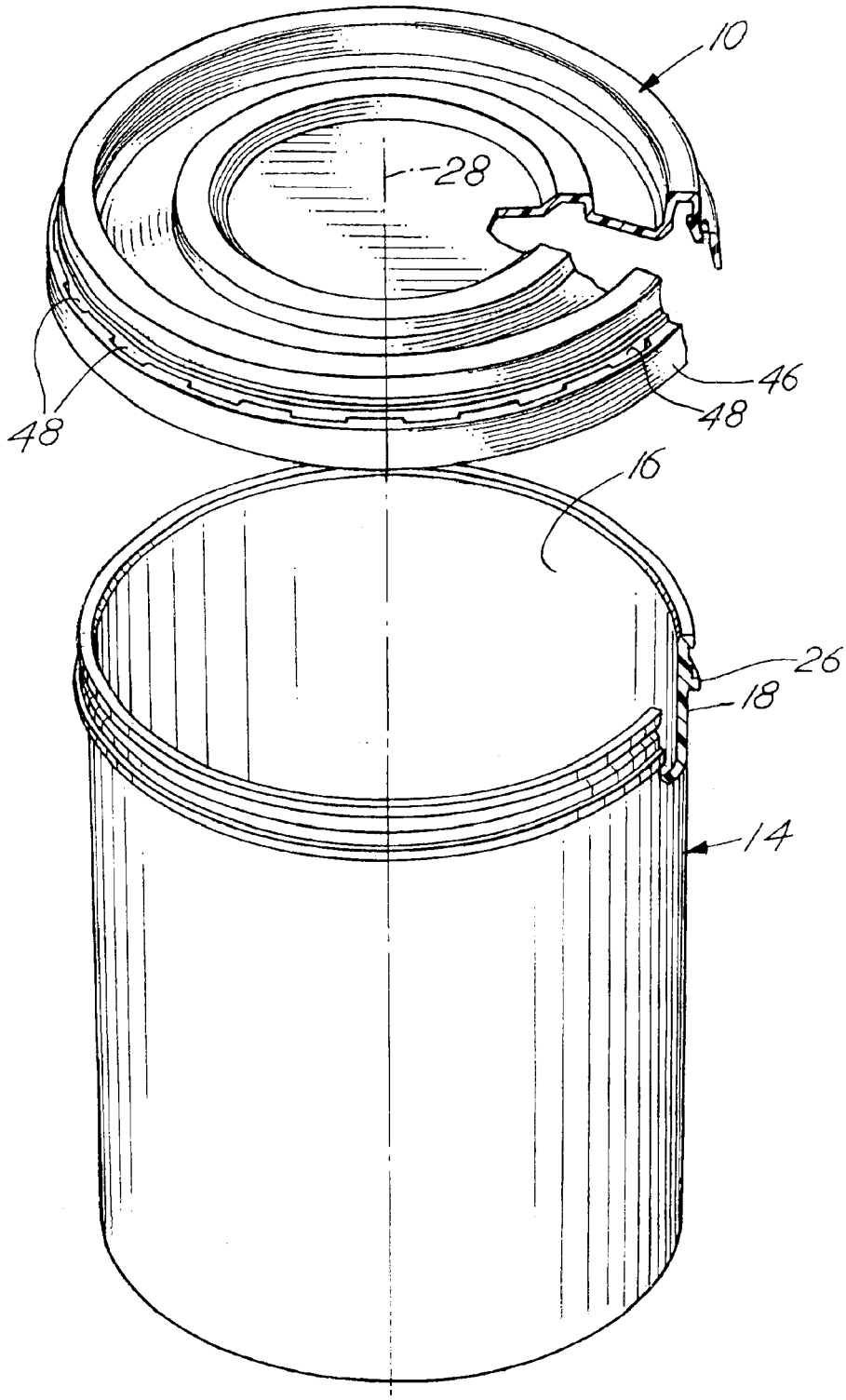
FIG. 1 is an exploded isometric view of the lid of the invention in combination with a molded plastic bucket.
Figure 2:
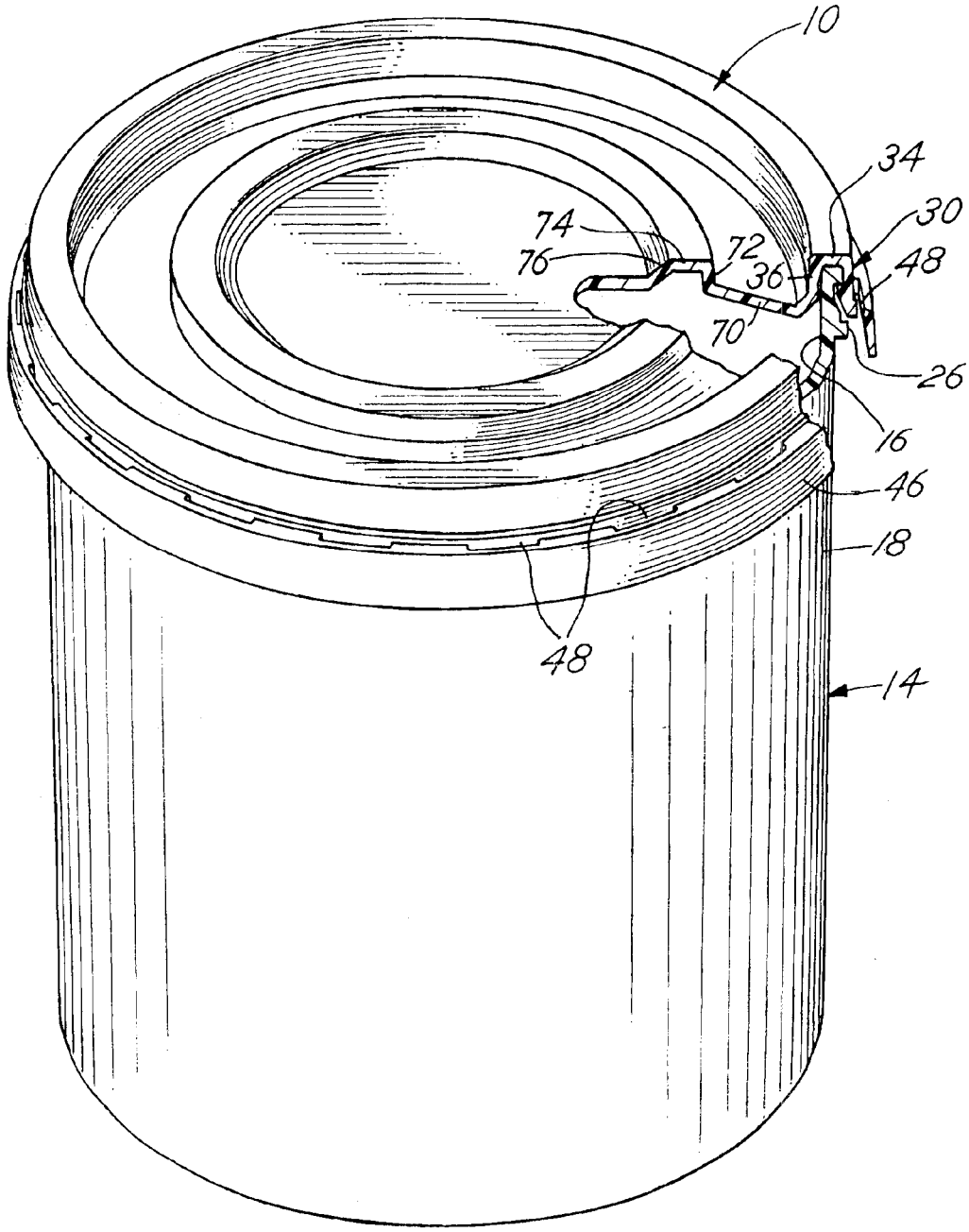
FIG. 2 is an isometric view of the combination of FIG. 1 wherein the lid has been positioned on the bucket and wherein there is a partial cut-away view of the lid attached to the bucket.

Referring to the figures, the subject matter of the invention principally relates to the construction of a molded plastic lid 10. the molded plastic lid 10 is fabricated by injection molding procedures generally, though other molding operations may be utilized in order to manufacture the lid 10. The lid 10 is utilized to close the rim, open end or top 12 of a bucket 14 having an inner bucket wall 16 and an outer bucket wall 18. The bucket 14 further includes, at its top rim or edge 12, a generally horizontal planar section 20, with an outwardly projecting lip 22 having an under surface 24. An optional, reinforcing circumferential rib 26 may be provided on the outside surface 18 of the bucket 14 spaced vertically downwardly from lip 22. The inside surface 16 is generally planar and constitutes a planar extension of the inside of the wall of the molded plastic bucket 14.

Figure 3:
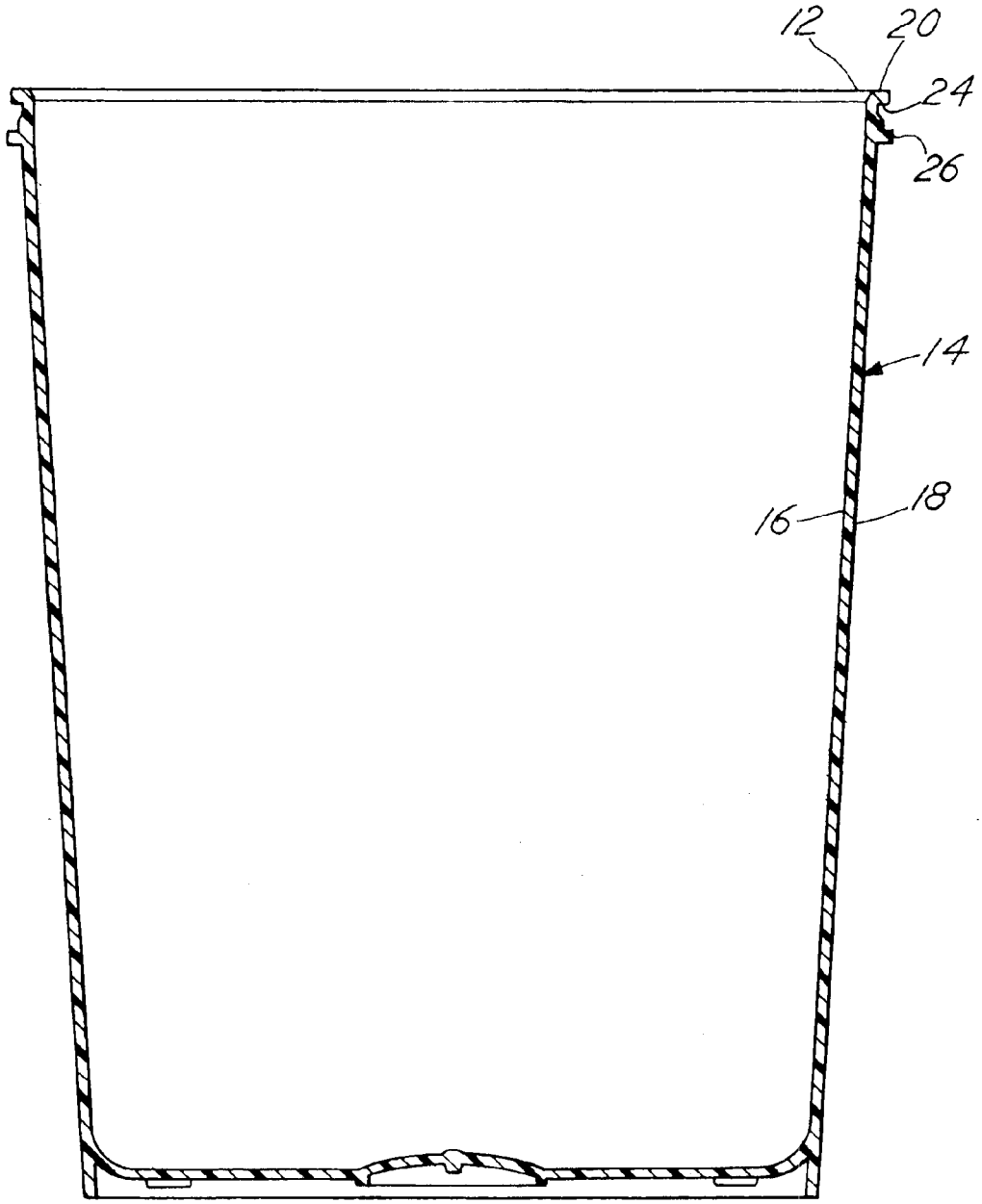
FIG. 3 is a cross sectional view of a typical bucket which may be used in combination with the lid of the invention.

In practice, the lid 10 of the invention is typically used in combination with a molded plastic bucket such as depicted in cross section in FIG. 3. However, the invention is not limited to the specific container depicted in the figures. For example, the bucket may be generally cylindrical as depicted in the drawings and the disclosure. However, the bucket may have other shapes including polygonal shapes, elliptical shapes and the like.

The lid, of course, is compatible with the open top or rim of the bucket. Thus, the bucket or container includes the outwardly projecting lip such as lip 22, a top surface 20 and inside surface 16 for coaction with the lid described herein. The invention is not limited to any particular container material. Rather, the lid of the invention may be utilized in combination with various types of containers to close or enclose the top of the container or a spigot. Further, the construction of the lid may be utilized in other environments, for example, as a cap or cover for a spray bottle or for various other types of containers which require a cap or lid to protect a nozzle, for example. Thus, the invention focuses upon the particular construction of the lid and, more particularly, the peripheral edge section of the lid. This is illustrated more completely in FIGS. 4 and 5.

Figure 4:
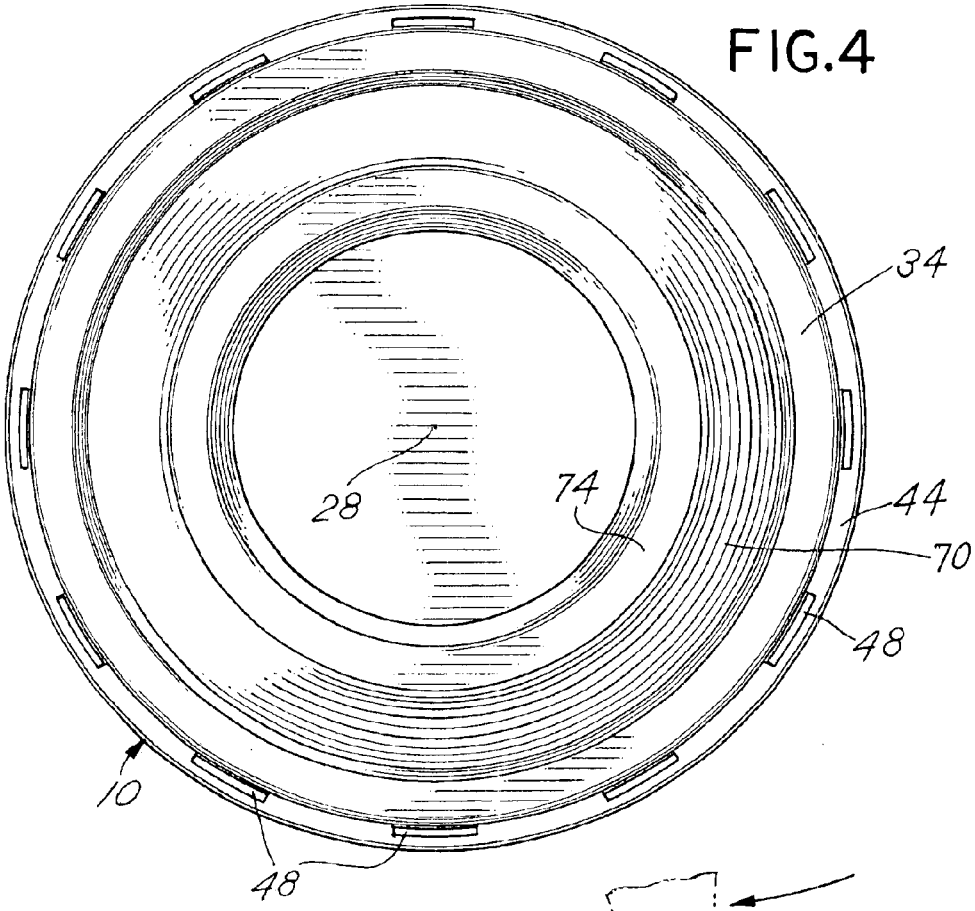
FIG. 4 is a top plan view of the improved lid of the invention.
Figure 5:
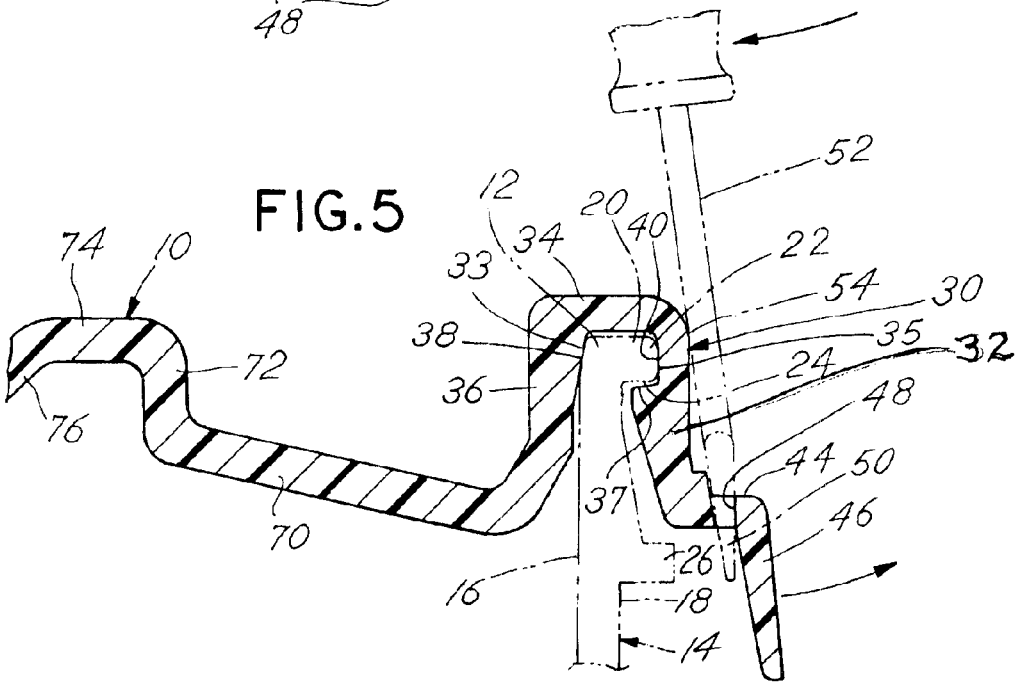
FIG. 5 is a partial cross sectional view of the lid of FIG. 4 taken along the line 5—5.

Referring, therefore, to FIGS. 4 and 5 and noting that the disclosure of those figures relates to a generally circular lid having a peripheral edge section 30, and a center line vertical axis 28, the lid as described is useful with a bucket having a top circular opening and rim compatible therewith. FIG. 5 illustrates in further detail the construction of the periphery or edge section 30 of the lid 10. In particular, the edge section 30 includes an outer depending, first gripping flange or hoop 32, an inwardly extending horizontal section or run 34, a spaced inwardly and downwardly depending second flange or hoop 36. The hoop 36 comprises a circumferential or circular hoop in the top of lid 10 to provide hoop strength to the lid 10 and insure the structural integrity of the lid 10. The horizontal section or run 34 includes an inward extent or wall 33 and an outer extent or wall 35. The inner hoop 36 depends downwardly from the inner extent 33. The first gripping flange or hoop 32 depends from the outer extent 35. The first gripping flange 32 includes an inwardly projecting lip 37 dimensioned and positioned to fit under the lip 22 of the bucket 14 when lid 10 is mounted on bucket 10. The hoop 36 includes a sealing surface section or surface 38. The downwardly extending or depending gripping flange 32 includes a sealing surface 40. The top edge or rim 12 of the bucket 14 is compressed between the hoop 36 and the downwardly extending gripping first flange or hoop 32 in a manner whereby the sealing surfaces 38 and 40 are engaged with the rim 20 of the bucket 14. Inwardly extending projection 37 insures that the lid 10 will remain in place on top of the bucket. The second hoop 36 and the spaced, annular first flange or hoop 32 both provide hoop strength to the top of the lid and, inasmuch as the molded plastic material is somewhat elastic, provide a means for enhancing the seal between the lid 10 and the bucket 14.

The edge section 30 further includes a projecting horizontal shelf section 44 at the lower end of the first flange 32. The shelf section 44 extends radially outwardly from the flange 32 and terminates with a downwardly depending manual lid release flange 46. A horizontal slot 48 is provided in the horizontal shelf 44. The slot 48 is designed to receive a blade 50 of a tool, for example, a screwdriver, which is placed through the slot 48. In this manner, the shaft or shank 52 of the screwdriver or other tool may fit against the upper outer extension of the horizontal run 34 or upper edge of first flange 32 of the lid 10 thereby serving as a fulcrum for the tool. When the tool is pivoted, as depicted by the arrow in FIG. 5, the shaft 52 will rotate counterclockwise about the fulcrum 54 causing the blade 50 in the slot 48 to pivot in a counterclockwise direction as indicated by the arrow in FIG. 5. When so pivoted, the circumferential annular first flange 32 will flex outwardly in a manner which permits release of the lid lip 37 from bucket lip 22. Such release is enhanced or may be solely effected by virtue of the flange 46 being manually gripped and moved in the direction of the arrow in FIG. 5. The flange 46 thus extends laterally on opposite sides of the slot 48 to facilitate manual gripping. The flange 46 also provides additional hoop strength, while simultaneously providing a means for distorting or elastically deforming the primary locking hoop or flange 32.

The lid 10 may include further formed sections which enhance the hoop strength of the lid. For example, the lid 10 may include an inwardly extending generally horizontal section 70 connected with a vertical hoop section 72, a horizontal annular section 74 and a downwardly depending inclined annular hoop section 76. The hoop sections 72 and 74 enhance the structural integrity of the lid 10. In practice, the manual release extension flange 46 which incorporates the slot 48 extends partially peripherally about the outer edge section 30 of the bucket lid 10 and, more particularly, in the range of approximately 15–30° along the edge section 30. Further extension is deemed to be undesirable inasmuch as the flange 46 tends to provide hoop strength or rigidity to the lid. This function is somewhat contrary to the desired function to permit elastic deformation of the downwardly depending flange 32. Nonetheless, it is possible to include a series of such extension flanges such as the flange 46 spaced about the periphery of the rim of the bucket lid. Further, it is possible to vary the radial distance of the first hoop flange 32 from the second depending hoop 36 so as to accommodate and be compatible with the rim of a bucket. Thus, there are many variations from the described embodiment and the invention should be limited only by the following claims and equivalents thereof.

What is claimed is:

1. A molded plastic lid for use in combination with a bucket, said bucket having an open top with a circumferential top rim, said lid comprising, in combination:

a central portion for covering the open top of the bucket; and a peripheral lid edge section for engaging and fastening to the top rim of the bucket, said peripheral lid edge section including a first outer depending gripping flange with an inwardly projecting lip for gripping the top rim of the bucket, said peripheral lid edge section further including a generally horizontal, radially outwardly extending shelf with an outer extension, and a lid-release flange extending downwardly from the outer extension of said shelf and at least partially radially outwardly from the first depending gripping flange, said lid-release flange extending at least partially circumferentially around the peripheral lid edge section, and at least one generally vertical slot through the horizontal shelf for receipt of a tool blade for elastically deforming the first gripping flange to disengage the inwardly projecting lip thereof from a bucket top rim.

2. The lid of claim 1 wherein the lid release flange comprises a depending extension flange from the first gripping flange for manual gripping and elastically deforming the first gripping flange to disengage from a bucket top rim.

3. The lid of claim 1 wherein the lid edge section in radial cross section, at least in part, comprises a generally horizontal top run, having an outer radial extent and an inner radial extent, a generally vertical depending run at the outer extent comprising said first gripping flange, said lip comprising a radially inwardly extending run from the vertical depending run, said edge section in radial cross section further comprising a second downwardly directed flange from the inner radial extent to define a lid sealing surface for a top rim of a bucket, and a bucket in combination with the lid, said bucket having a top rim with a radial cross section including an inclined sealing surface in opposed sealing contact with said lid sealing surface.

4. The lid and bucket combination of claim 3 wherein the bucket rim in radial cross section comprises a shape compatible with the interior surfaces of the lid edge section and said bucket rim is compressed between the first and second spaced vertical and downwardly directioned flanges of the lid edge section.

5. The lid of claim 3 or claim 4 wherein the lid release flange comprises an extension flange from the first gripping flange for manual gripping and for elastically deforming the first gripping flange to effect disengagement from the bucket rim.

* * * * *